US008287002B2

(12) United States Patent
Witecha

(10) Patent No.: US 8,287,002 B2
(45) Date of Patent: Oct. 16, 2012

(54) PLASTIC COATED PROMOTIONAL CARD

(75) Inventor: Kirk Joseph Witecha, Delray Beach, FL (US)

(73) Assignee: Postalinventions.com, LLC, Boca Raton, FL (US)

( * ) Notice: Subject to any disclaimer, the term of this patent is extended or adjusted under 35 U.S.C. 154(b) by 762 days.

(21) Appl. No.: 11/043,179

(22) Filed: Jan. 27, 2005

(65) Prior Publication Data

US 2006/0163867 A1 Jul. 27, 2006

(51) Int. Cl.
*B42D 15/04* (2006.01)
*B42D 15/00* (2006.01)

(52) U.S. Cl. ..... 283/56; 283/105

(58) Field of Classification Search ..... 283/56, 283/74, 75, 103, 105, 62, 116, 117; 29/74, 29/92, 92.1, 92.8; 40/360; 428/43, 68, 76
See application file for complete search history.

(56) References Cited

U.S. PATENT DOCUMENTS

| | | | | |
|---|---|---|---|---|
| 3,457,661 | A * | 7/1969 | Peters | 283/109 |
| 5,531,482 | A * | 7/1996 | Blank | 283/67 |
| 5,921,584 | A * | 7/1999 | Goade, Sr. | 283/107 |
| 6,092,841 | A * | 7/2000 | Best et al. | 283/56 |
| 6,328,341 | B2 * | 12/2001 | Klure | 283/62 |
| 6,623,039 | B2 * | 9/2003 | Thompson et al. | 283/61 |
| 2003/0090103 | A1 * | 5/2003 | Becker | 283/56 |

* cited by examiner

*Primary Examiner* — Dana Ross
*Assistant Examiner* — Pradeep C Battula
(74) *Attorney, Agent, or Firm* — Lowe Hauptman Ham & Berner, LLP

(57) ABSTRACT

A generally rectangular plastic coated promotional card for use as a mailer or handout has a paper core and a plastic coating on each side thereof. The promotional card also includes a removable credit card with four rounded corners. The promotional card itself may include four rounded corners and instructions for activating the card or obtaining a free gift.

3 Claims, 1 Drawing Sheet

PLASTIC COATED PROMOTIONAL CARD

FIELD OF THE INVENTION

This invention relates to a plastic coated promotional card and more particularly to a single thickness mailer and/or handout with a removable credit card incorporated therein.

BACKGROUND FOR THE INVENTION

Promotional mailers and handouts are well known. For example, a U.S. Patent of Kim, U.S. Pat. No. 6,269,158 discloses the combination of a postal communication and a telephone calling card. As disclosed therein, the postal communication card is a pre-stamped and/or bulk rate postpaid postcard which is separated from the calling card by a perforated edge and which can be mailed within an envelope. The card may also include a toll free number on a designated region of the card which can access a database to pick-up a voicemail message. As suggested in the Kim patent, it may also include a gift certificate or coupon and an appropriate toll free number. In this way, a sender may send gift certificates, coupons or advertising notices which are inscribed on the card. The recipient may then call a toll free number, enter the recipient's account number and activate the coupon or certificate or the user may mail back a signed communication to the sender or leave a voicemail or recorded message.

A social expression card with a detachable gift portion is disclosed in a U.S. Pat. No. 6,493,970 of McCarthy et al. As disclosed therein a social expression card with a detachable gift portion includes a first panel and a second panel connected by a foldline to the first panel. The second panel is foldable over the first panel to form a card. A third panel which includes a detachable gift portion is connected by a foldline to the second panel and is folded over the second panel to a position in which the detachable portion is hidden between the first and second panels when the second panel is folded over the first panel. The detachable portion includes gift indicia such as gift certificates, photographic images and the like.

A more recent patent of Huff et al., U.S. Pat. No. 6,499,664 discloses a postcard for carrying a compact disc. As disclosed therein, the postcard includes a first sheet which contains on its front side an area or an image or message and means for attaching a disc medium such as a clear plastic pocket. The postcard includes a filler card and optionally an insert sheet and is covered by a transparent plastic layer applied by a shrink wrap process enclosing the first sheet, filler card and insert, if any. The area for providing postal information is preferably a paper label applied adhesively to the backside of the postcard over the transparent layer.

Notwithstanding the above, it is presently believed that there is a large commercial market for an improved plastic coated promotional card in accordance with the present invention. There should be a large commercial market because such cards are durable, pass through postage handling machines without problems and have a pleasing appearance that last for long periods of time and which is not damaged by postal handling machines or the like. Further advantages reside in a removable credit card positioned on one corner of the plastic coated promotional card and bounded by the top or bottom of the promotional card and an adjacent side thereof. The credit card is readily separable from the promotional card along a series of generally perpendicular and intersecting openings and adjacent tabs and wherein the perforations define three-rounded corners. In one embodiment of the invention the promotional card includes at least one-rounded corner which produces a fourth-rounded corner of the credit card.

Other advantages reside in the construction and thickness of the promotional card. For example, the transparent plastic coating on each side of the card provides a pleasing appearance, a durable surface, can be manufactured on conventional equipment, and can be produced at a reasonable costs.

BRIEF SUMMARY OF THE INVENTION

The present invention contemplates a plastic coated promotional card for use as a handout or mailer. The promotional card has a generally rectangular shape with four sides and a length which is greater than its width. The promotional card also includes a generally rectangular preprinted core, preferably of paper, with a plastic coating on each side thereof and bonded thereto and wherein the paper core and coatings each have a thickness of about 0.010 inches for a total thickness of between about 0.020 and 0.040 inches and a removable credit card having the same thickness. The removable credit card is formed by two adjacent sides of the promotional card and has the dimensions of a standard credit card, i.e., about 3⅜ by 2⅛ inches and four rounded corners to facilitate putting the card into a wallet or the like. The removable credit card is defined by two adjacent sides of the promotional card and a series of perpendicular and intersecting opening and adjacent attachment tabs which define at least three rounded corners and intersect with each other and the two adjacent sides. The promotional card has two preprinted surfaces that is a first surface and a second surface one of which displays promotional information, pictures and the like. The second side includes a portion adjacent to the removable credit card for postal information such as a postal permit number, a return address and name and address of an intended recipient or other information.

The invention will now be described in connection with the following figures wherein like numbers have been used to identify like parts.

DESCRIPTION OF THE PREFERRED EMBODIMENTS OF THE INVENTION

Figure 1:
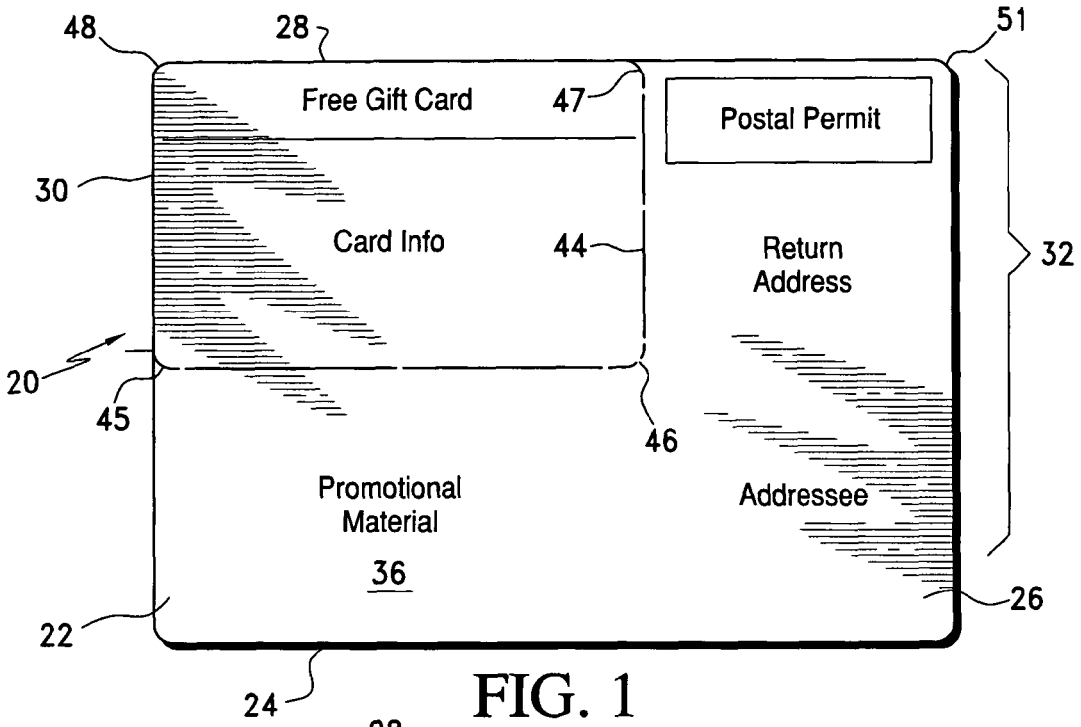
FIG. 1 is a front view of one side of a plastic coated promotional card in accordance with the invention.
Figure 2:
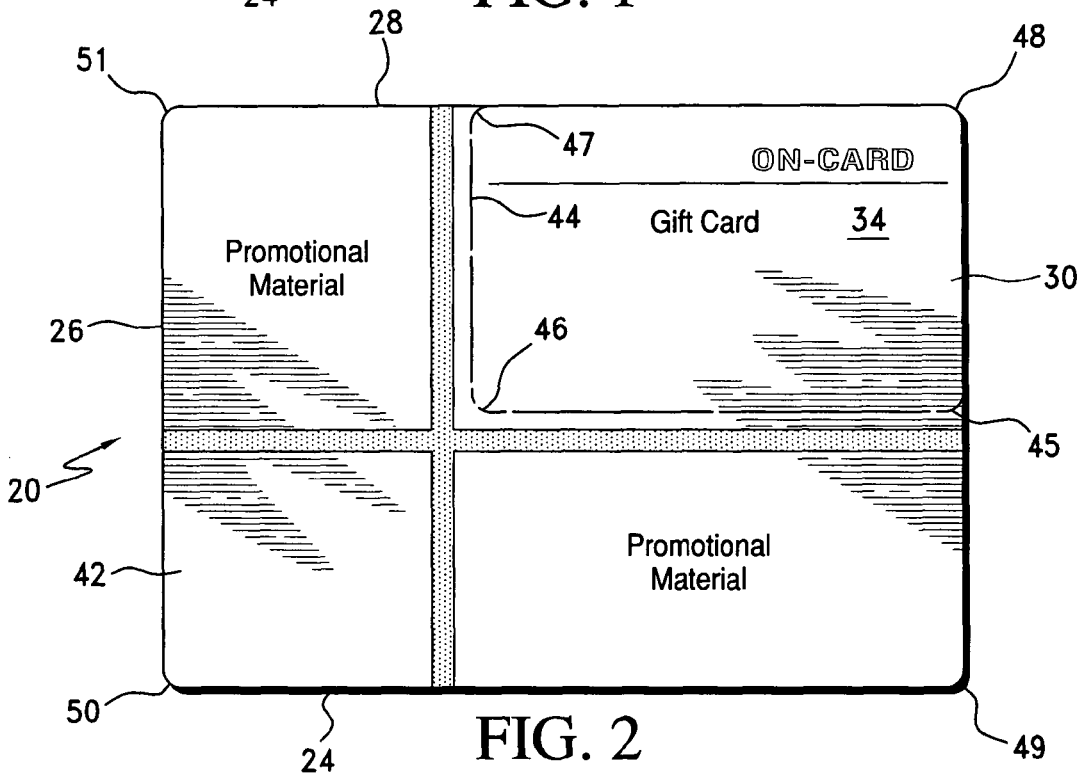
FIG. 2 is a second surface of the promotional card shown in FIG. 1.
Figure 3:
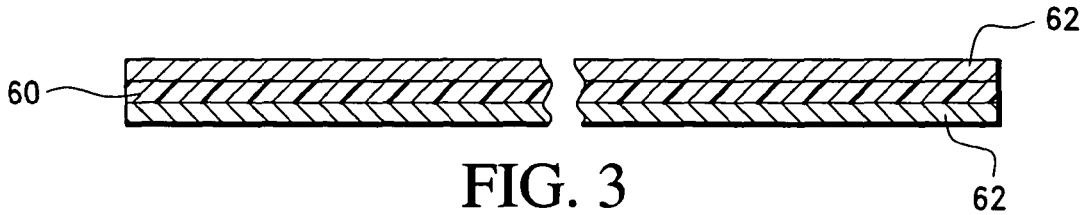
FIG. 3 is an end view of the promotional card shown in FIGS. 1 and 2.

As shown in FIGS. 1-3 a promotional card 20 includes a first or rear surface 22 and four sides 24, 26, 28 and 30 which define a rectangular shape. The preferred embodiment of the invention has a rectangular shape of 4 inches by 5¼ inches. However, the card 20 may vary from about 3 inches by 5 inches to about 6 inches by 8 inches as long as it meets postal regulations. In a second preferred embodiment of the invention, the card 20 has a rectangular shape of about 5½ inches by 8 inches. As illustrated, the sides 24 and 28 are parallel while sides 26 and 30 are parallel, but perpendicular to sides 24 and 28. As illustrated, the promotional card 20 has a length which is greater than its width. The promotional card includes a first portion 32 on a first or rear surface 22 for mailing or other information. For example, when used as a promotional mailer, the portion 32 includes a postal permit number in an upper right hand corner, a return address below that and the intended recipient's name and address below the return address. As shown, the mailing or other information in the portion 32 are outside of an area reserved for a removable credit card 34. An additional area 36 may be used for additional promotional material or an announcement of a free gift, photo etc.

An opposite surface 42 also includes preprinted promotional material which is printed prior to the addition of the plastic coatings or layers which will be described hereinafter with respect to FIG. 3. The opposite surface 42 also includes an area corresponding to the removable credit card 34. The area corresponding to the removable credit card and on either side thereof may include a toll free number for activating the card and/or redeeming a free gift, a pin number or account number for tracking the cards use, and/or advertising and promotional material.

The removable credit card 34 is defined by a series of generally perpendicular and intersecting openings and adjacent attachment tabs 44 which intersect with the top 28 and adjacent side 30 of the promotional card 20 or with the bottom 24 and adjacent side 30 which are outside of the portion 32. The coated card is die cut to provide a series of holes or openings and attachment tabs 44. However, unlike perforations in paper, the attachment or connecting tabs amount to less than 10 percent and preferably about 4½ percent of the length and width of the removable credit card 34. Raising the percentage of tabs to openings would make it difficult, if not impossible, for an average individual to remove the credit card 34 from the promotional card 20. On the other hand, reducing the percentage of tabs could result in the credit card being inadvertently separated from the promotional card 20.

Engineering tests showed that varying the number and width of the tabs overcame problems associated with damage by automated mailing equipment and difficulty in separating the credit card 34 from the promotional card 20 by the recipient. In a preferred embodiment of the invention, a credit card 34 was attached to the promotional card by nine tabs 44. The width of seven of the tabs 44 were about thirty 0.030 inches while the tab 44 at the corner 45 and 47 have a width of about 0.020 inches.

An important aspect of the present invention resides in the openings and adjacent attachment tabs 44 which define at least three rounded corners 45, 46 and 47 of the removable credit card 34. The rounded corners 45, 46 and 47 and a fourth rounded corner 48 facilitate putting the credit card into a wallet or credit card folder and minimize the likelihood of a sharp corner inflicting a minor injury such as a scratch to a user. The rounded corners have a radius of between about 1/16 inch and 3/16 inch and preferably about ⅛ inch.

In a preferred embodiment of the promotional card 20 also includes four rounded corners 48, 49, 50 and 51. The rounded corners 48, 49, 50 and 51 also have a radius of between about 1/16 inch and 3/16 inch and preferably about ⅛ inch. These rounded corners like those on the removable credit card avoid minor injuries and possible infections resulting from scratches inflicted by a sharp corner of the promotional card 20. Further the rounded corners do not cause problems with automated mail handling machines as presently used by the postal service. As presently understood, postal regulations do not permit rounded corners on most mailers. However, based on testing, mailers in accordance with the present invention are presently approved for mailing.

As illustrated in FIG. 3, the promotional card 20 has a paper core 60 and transparent plastic coating 62 on each side of the paper core 60 to form a single sheet mailer. The paper core 60 and each of the plastic coatings 62 preferably having a thickness of about 0.010 inches so that the total thickness of the promotional card 20 including the removable credit card 34 have a thickness of about 0.030 inches. The plastic coating or laminate may be polyethylene, or other suitable plastic as will be well understood by persons of ordinary skill in the art. It is also believed that the paper core 60 may be made of Teslin® sheets or other suitable material as will be well understood by persons of ordinary skill in the art.

While the invention has been described in connection with the preferred embodiment, it should be recognized that changes and modifications may be made therein without departing from the scope of the appended claims.

What is claimed is:

1. A single thickness promotional mailer with a removable credit card incorporated therein, said mailer comprising:

a promotional card having a generally rectangular shape with parallel top and bottom edges and parallel ends perpendicular to said top and bottom edges, a width and length of about 4 inches by about 5½ inches, said promotional card including a generally rectangular preprinted paper core and wherein said promotional card has a thickness of about 0.030 inches;

a removable credit card having a length and width of about 3⅜ inches by 2⅛ inches formed by two adjacent sides of said promotional card and a series of generally perpendicular and intersecting openings and connecting tabs with said openings and connecting tabs defining three rounded corners of said removable credit card with a radius of about ⅛ inch and said connecting tabs amounting to less than 10% of the length and width of the removable credit card; and said rectangular preprinted paper core having front and rear surfaces with one of said surfaces displaying promotional material and a second of said surfaces displaying postal information including a postal permit and a second portion adjacent to said postal information for additional promotional material and in which said promotional card has four rounded corners each of which has a radius of about ⅛ inch and in which said promotional cards pass through postal handling machines without damage and include means for activating said removable credit card.

2. A single thickness plastic coated promotional mailer with a removable credit card incorporated therein, said mailer comprising:

a promotional card having a generally rectangular shape with parallel top and bottom edges and parallel ends perpendicular to said top and bottom edges, a width and length of about 4 inches by about 5½ inches, said promotional card including a generally rectangular preprinted paper or synthetic core with a plastic coating on each side thereof and wherein said paper core and said plastic coatings on each side thereof each have a thickness of about 0.010 inches so that the promotional card has a thickness of about 0.030 inches and wherein said plastic coatings on each side of said core are bonded thereto;

a removable credit card having a length and width of about 3⅜ inches by 2⅛ inches formed by two adjacent sides of said promotional card and a series of generally perpendicular and intersecting openings and connecting tabs with said openings and connecting tabs defining three rounded corners of said credit card with a radius of about ⅛ inch and said connecting tabs amounting to less than 10% of the length and width of the removable credit card; and said generally rectangular preprinted paper or synthetic core having front and rear surfaces with one of said surfaces displaying promotional material and a second of said surfaces displaying postal information including a postal permit and a second portion adjacent to said postal information for additional promotional material and in which said promotional card has four rounded corners each of which has a radius of about ⅛ inch and in which said promotional cards pass through postal handling machines without damage and include means for activating said credit card.

3. A single thickness plastic coated promotional mailer with a removable credit card incorporated therein, said mailer comprising:

a promotional card having a generally rectangular shape with parallel top and bottom edges and parallel ends perpendicular to said top and bottom edges and said card varying from about 3 inches by 5 inches to about 6 inches by 8 inches, and said promotional card including a generally rectangular preprinted paper or synthetic core with a plastic coating on each side thereof and wherein said promotional card has a thickness of about 0.030 inches and wherein said plastic coatings on each side of said core are bonded thereto;

a removable credit card having a length and width of about 3⅜ inches by 2⅛ inches formed by two adjacent sides of said promotional card and a series of generally perpendicular and intersecting openings and connecting tabs with said openings and connecting tabs defining three rounded corners of said credit card with a radius of about ⅛ inch and said connecting tabs amounting to less than 10% of the length and width of the removable credit card; and said preprinted core having front and rear surfaces with one of said surfaces displaying promotional material and a second of said surfaces displaying postal information including a postal permit and a second portion adjacent to said postal information for additional promotional material and in which said promotional card has four rounded corners each of which has a radius of about ⅛ inch and in which said promotional cards pass through postal handling machines without damage and include means for activating said credit card.

* * * * *